United States Patent [19]

Stoev et al.

[11] 4,070,275

[45] Jan. 24, 1978

[54] MATERIAL TREATING APPARATUS INCLUDING PNEUMO-HYDRAULIC VIBRATOR

[75] Inventors: Stoycho Mitrev Stoev; Metodi Stoyanov Metodiev; Lyubomir Vladimirov Kuzev; Petko Georgiev Vedrichkov; Ivan Mitrev Sapunarov; Vassil Vladimirov Vassilev; Spas Petkov Dimitrov; Vihar Assenov Gasharov; Sheko Kolev Russev; Kostadin Georgiev Mitrev, all of Sofia, Bulgaria

[73] Assignee: Vish Minno-Geoloshki Institute-Nis, Sofia, Bulgaria

[21] Appl. No.: 688,268

[22] Filed: May 20, 1976

[30] Foreign Application Priority Data

Feb. 19, 1974 Bulgaria ..... 25837

Related U.S. Application Data

[62] Division of Ser. No. 572,457, April 28, 1975, abandoned.

[51] Int. Cl.[2] ..... B03B 7/00

[52] U.S. Cl. ..... 209/44; 209/457; 209/502

[58] Field of Search ..... 209/425, 426, 427, 455–457, 209/500, 502, 44

[56] References Cited

U.S. PATENT DOCUMENTS

| | | | |
|---|---|---|---|
| 2,124,983 | 7/1938 | Martin | 209/455 X |
| 2,426,337 | 8/1947 | Bird | 209/426 X |
| 2,497,339 | 2/1950 | Bastanchury | 209/469 |

*Primary Examiner*—William A. Cuchlinski, Jr.

[57] ABSTRACT

Material treating apparatus including one or more pneumohydraulic vibrators. The apparatus includes a container with cells separated by at least one valve lying on a supporting frame, the valve having a movable valve element which is urged toward its valve-closed position by springs. On one side of the valve there is an air cell connected with a source of air under pressure, and on the other side of the valve there is a second cell containing a liquid or a liquid suspension of material to be treated. When the air cell is subjected to air under pressure the movable valve element vibrates and generates intensive vibro-pulsation turbulent streams in the liquid material in the second cell.

1 Claim, 6 Drawing Figures

Fig. 1
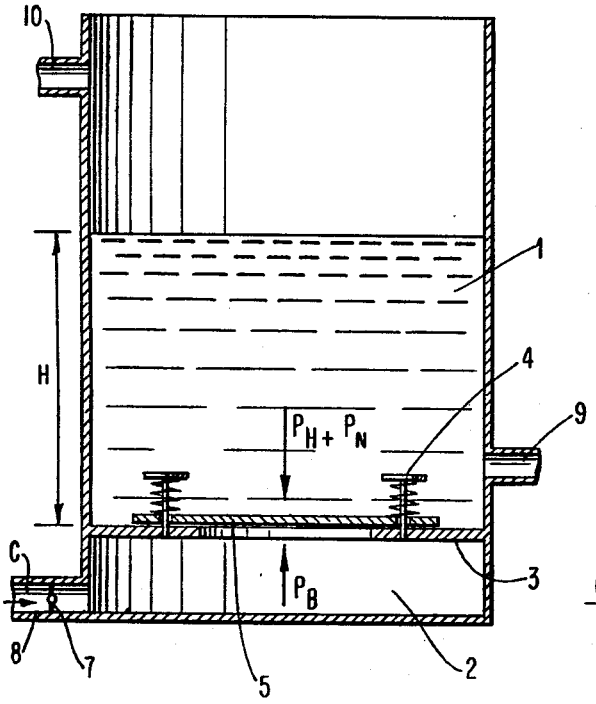
Fig. 2
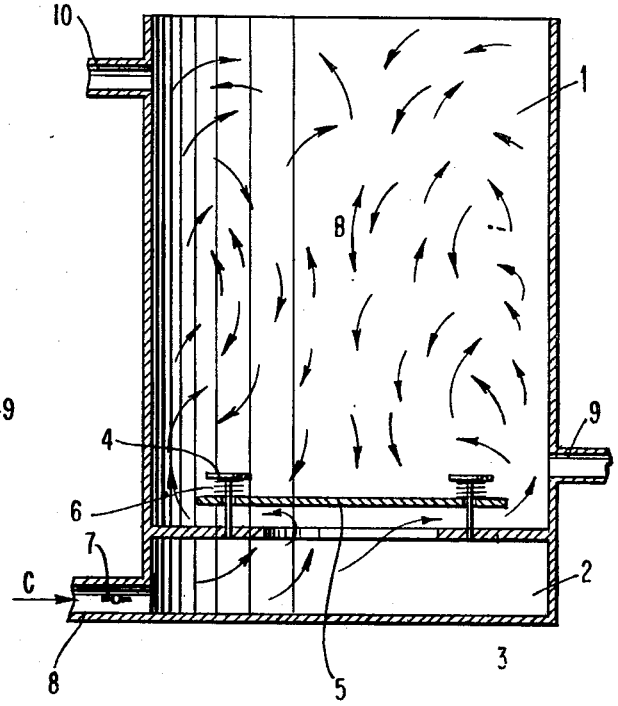
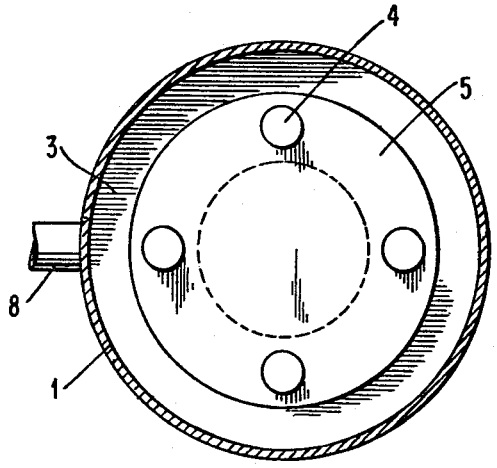
Fig. 3
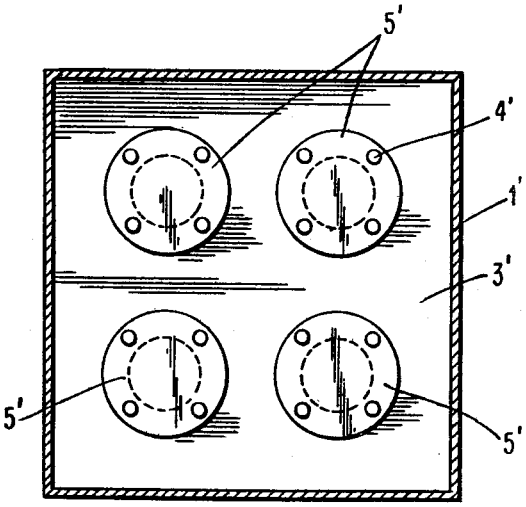
Fig. 4

MATERIAL TREATING APPARATUS INCLUDING PNEUMO-HYDRAULIC VIBRATOR

This is a division of application Ser. No. 572,457 filed Apr. 28, 1975 now abandoned.

This invention relates to material treating apparatus including at least one pneumo-vibrator for generating intensive vibro-pulsation turbulent streams in a liquid or a liquid-solid material suspension to be treated.

During the last few years a number of vibrator constructions have been developed in order to intensify production processes including the treatment of liquids or liquid-solid material suspensions. In some cases these known constructions contribute to a considerable increase of the efficiency of the technologies employed in the material treating process. Their disadvantage is that they involve vibrators, which makes the construction of the apparatus more expensive, and involves maintenance of the vibrators. When intensive vibrating is necessary, presently available vibrators are used in order to obtain the required effect. However, there are some technologies which cannot be intensified by the use of low intensity vibrations. Some processes are known, on the other hand, in which intensive vibration should not be applied. Thus, attempts to construct washing machines for household appliances using intensive vibrations proved unsuccessful because of the breaking of the vessels.

The present invention has among its objects the provision of a pneumo-hydraulic vibrator of simple construction which allows the generation of intensive vibro-pulsation turbulent streams, such vibrator being reliable in operation and simple to maintain. The vibrator of the invention is operated by either compressed air or sucked air, that is, air under reduced pressure; such air is often necessary for a given process. The pneumo-hydraulic vibrator devices based on these principles are called "self-vibration vibrators".

A number of embodiments of material treating apparatus of the invention, such embodiments including the pneumo-hydraulic vibrator of the invention, are shown in the accompanying drawings, in which:

FIG. 1 is a view in vertical cross section through a working cell provided with a pneumo-hydraulic self-vibrating device in accordance with the invention, the valve element of the vibrating device being shown in closed position;

FIG. 2 is a view similar to FIG. 1 but with the valve element of the vibrating device being shown in open position, FIG. 3 is a view in plan of the valve of FIGS. 1 and 2;

FIG. 4 is a view in plan of a support adapted to divide an air cell from a liquid or liquid-solid suspension material treating cell, such support carrying four valves similar to that shown in FIG. 3;

Figure 5:
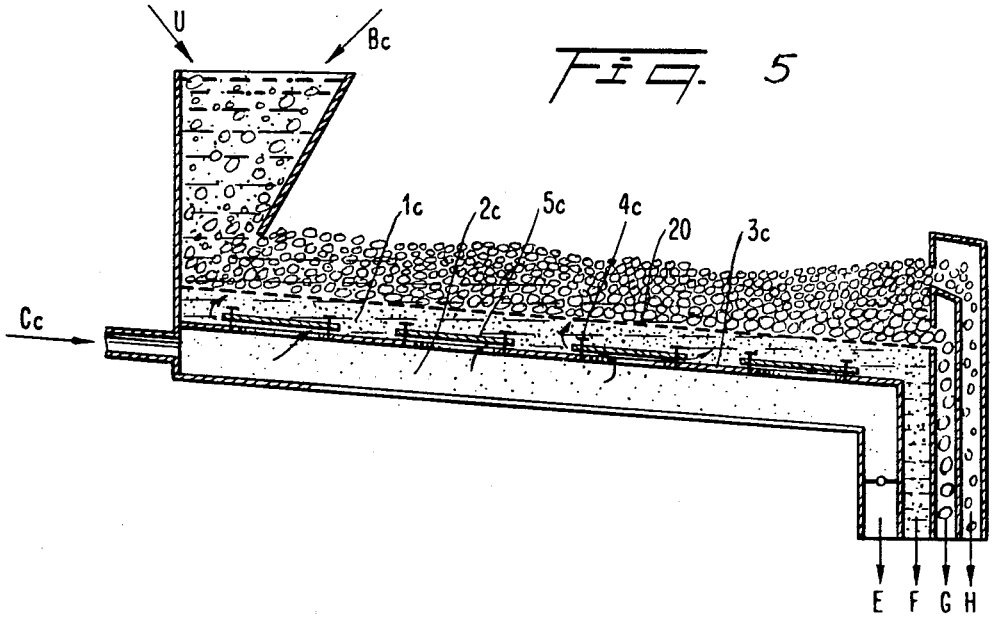
FIG. 5 is a view in vertical longitudinal cross section through a further embodiment of apparatus in accordance with the invention, such apparatus being employed for the stratification of mineral mixtures.

FIGS. 1 and 2 illustrate the principle and manner of operation of the pneumo-hydraulic self-vibrating device of the invention. A working cell 1 in the form of a tank containing liquid is disposed above an air cell 2 into which compressed air, designated C, enters through a conduit means 8 having a pressure regulating valve 7 interposed therein. At the top of the air cell 2 there are horizontal supporting members 3 which are disposed in the same plane and extend inwardly of the cell from the side walls thereof. The space between the supports 3 is spanned by a play-like movable valve element 5 which is mounted on vertical adjustable guide screws 4 which pass freely through holes in the valve element 5. Coil compression springs 6, which extend between the valve element 5 and heads on the screw guides 4 constantly urge the element 5 toward the closed position thereof shown in FIG. 1. Liquid or a liquid-solid material suspension is introduced into the top of the working cell 1 through conduit means 10 and is exhausted therefrom in the bottom thereof by a discharge conduit means 9.

Guiding screws 4 can be screwed into threaded openings in the supporting frame members 3. When the valve 7 is shut, the valve element 5 is pressed toward the opening between the supporting members 3 by the hydrostatic pressure of the liquid in the working cell 1 and the pressure of the spring 6 acting thereon. Increasing of the liquid volume obviously leads to increasing the height thereof, and therefore the pressing force defined by the hydrostatic pressure $P_H$. By means of the screws 4, the second component of the pressing force $P_S$ can be changed as a result of the change in the degree of compression of the springs; this also changes the length of the path through which the valve element 5 may move between the supports 3 and the heads of the screws 4.

Upon the opening of the valve 7 the air pressure in the air cell 2 rises and as soon as the force $P_B$ which is dependent upon it and which acts upon the valve becomes greater than $P_H + P_S$, the valve element 5 is raised and releases air through the gap formed between the valve element and the supporting frame members 3. As the valve element 5 moves upwardly, the liquid beneath the valve in the liquid between the valve and the container walls are pushed upwardly in a vertical direction due to the entering of air from the cell and the formation of air-lift conditions. After a certain quantity of air has escaped through the open valve, the pressure in the air cell 2 drops and the valve element 5, under the action of the pressing force, descends into the position thereof shown in FIG. 1 so as to stop the escape of air from the air cell 2 into the working cell 1. Obviously the whole quantity of liquid, due to its own weight, moves downwardly.

This cycle is repeated because of the again rising air-pressure in the air cell. The repeating of the cycle, i.e., the frequency of vibration depends upon the value of the pressing force. This is why the frequency can be controlled by changing the height H of the liquid in the working cell and the compressive force of the springs 6. As a result of the vibration of the valve element 5 and the periodic escape of air from the air cell 2 into the working cell 1, conditions for effective turbulence in the liquid occur in the working cell. This can considerably increase the mass and heat transfer between various parts of the liquid. The container which forms the working cell 1 and the air cell 2 may be of a variety of shapes. The number of valves having valve elements 5 also can vary and is determined by the horizontal area of the working cell.

In FIG. 3 there is shown a working cell 1 with a round horizontal cross section, cell 1 being provided with one valve having a valve element 5. In FIG. 4 there is shown a rectangular cell 1' which is provided with four valves having valve elements 5' mounted on adjusting screws 4 which in turn are secured to a square plate 3+ which is of the same shape as the horizontal section of the cell 1'. The construction of the valve with valve element 5 which is shown in FIGS. 1 and 2 can be simplified by the removal of the spring 6. The hydrostatic force exerted by the liquid in the working cell is usually enough to attain an effective frequency and amplitude of the vibrations of the valve element 5.

The above-described pneumo-hydraulic vibrator can be used for solving a number of problems in the laboratory, as well as industrial and domestic problems, connected with heat and mass transfer. The vibrator is best illustrated in conjunction with its use in a number of processes now to be described.

Modification of Mineral Mixtures by Specific Weight in Clean Water or Heavy Suspension A preferred example of this embodiment of the invention is shown in FIG. 5. Parts of such apparatus which are generally similar to those shown in FIGS. 1 and 2 are designated by the same reference characters with an added subscript *c*. The air cell 2*c* and the working cell above it are elongated in the direction of feeding of the material. A mixture of mineral U and water $B_C$ are introduced into a hopper at the left-hand end of the apparatus, such mixture continually moving to the right due to the pulsations supplied thereto by the vibrator having a valve element 5*c* and the fact that the apparatus provide ideal conditions for grain movement. Thus, such grains move in accordance with Mayer's theory, wherein the particles strive to obtain a minimum potential energy. As a result of this, the heavy mineral is concentrated in the lower layer and the light mineral is concentrated in the upper layer. The mixture of mineral and water is delivered onto a slightly inclined grid 20, and due to the transportation ability of the accompanying water and the conditions provided for easy movement of the mineral, particularly because of its being fluffed up by the action of the valve element 5*c*, the mineral moves to the lower, right-hand end, being simultaneously stratified by gravity as it moves. By means of known jig devices, the light mineral layer F is separated from the heavy mineral layers G and H. Fine material E, passing through the screen 20, is directed for further processing by other methods. The present device unites the advantages of the hydraulic and pneumatic jigs, without the necessity of complex mechanical devices for causing the pulsations. When stratification of mineral mixtures with small differences in their specific weights is needed, a coarse-grain suspension can be supplied simultaneously with the mineral. The effect of this suspension, combined with the effect of fluffing up caused by the action of the vibrator, increases the efficiency of the process.

Disintegration and Washing

Figure 6:
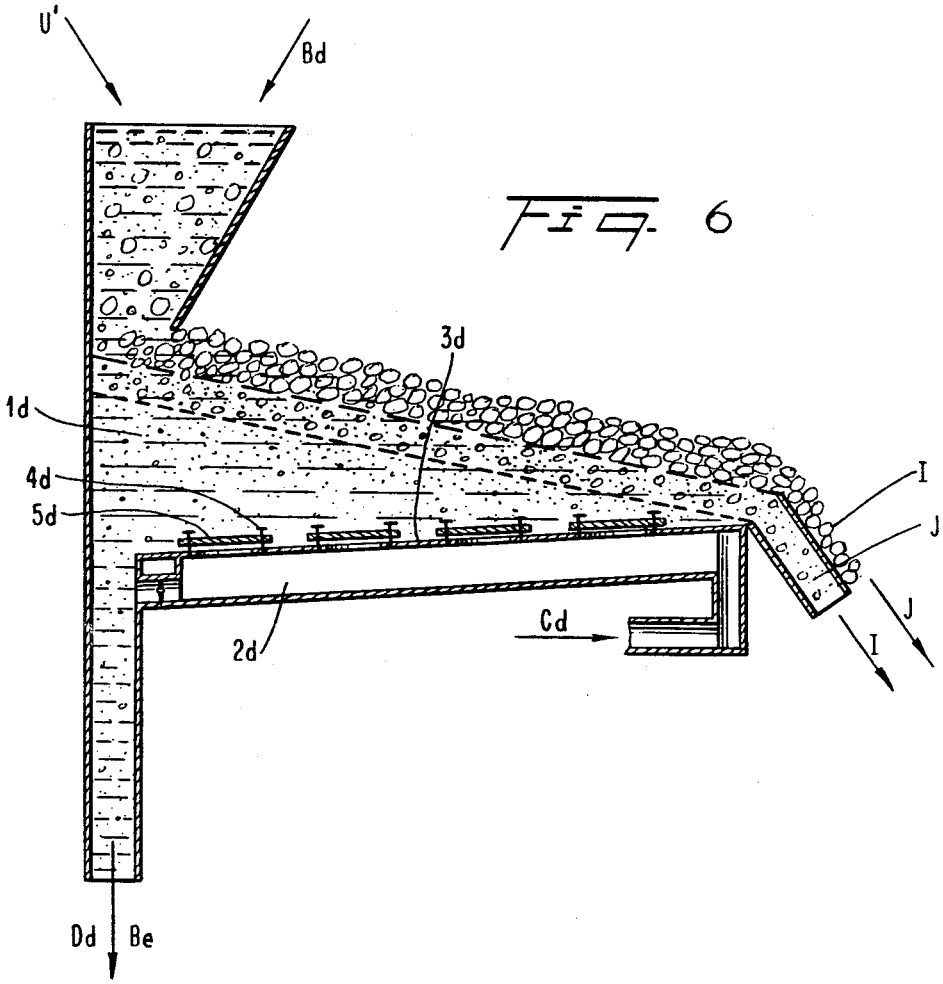
FIG. 6 is a schematic view in vertical longitudinal cross section through an further embodiment of apparatus in accordance with the invention, such apparatus being employed for disintegration and washing of material.

When raw materials with some clay content are put in a working cell, there is produced a disintegration of the materials due to the intensive turbulence prevailing in the apparatus. The material is freed from dirt by a washing operation. In FIG. 6 there is shown a preferred embodiment for carrying out these processes. In FIG. 6 parts which are generally similar to those shown in FIGS. 1 and 2 are designated by the same reference characters with the added postscript *d*. A mineral U' in particulate form with water B*d* are introduced into a hopper at the left-hand end of the apparatus, such apparatus being provided with two vertically spaced inclined screens placed one above the other, as shown. The mineral U' and water B*d* are subjected to pulsation turbulence that disperses the clay. Coarse-grained particles move over the upper screen and are discharged at I without clay impurities. Middle-sized material passing over the lower screen moves over it and is discharged at J. The finest sand D*a* and the thus formed clay suspension B*e* issue from a vertical discharge pipe at the extreme left of the apparatus. The air cell 2*d* is connected with the clay discharging pipe through a selectively operated valve, as shown, for removal of sand which may be incidentally passed under the valve elements 5*d*.

When the machine is used only for disintegration (for instance with kaolin ores), it is necessary to employ only one screen with a vertical controlling screen mounted on its edge to control the size of the disintegrated material.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An apparatus for stratifying ore in particulate form suspended in a solution in accordance with the density of the ore particles and for washing the crude ore particles, such apparatus having a working cell for receiving a solution having ore particles to be treated, the improvement which comprises a gas cell disposed at least partially below said working cell, partition wall means separating the working cell and the gas cell and having at least one horizontal aperture therein for providing vertical communication between the working cell and the gas cell, a valve associated with the partition wall means and having a valve element disposed above the aperture and normally urged into a closed position by the weight of the liquid in the working cell when the solution having ore particles to be treated is introduced into the working cell, means for introducing a pressurized gas into said gas cell to urge said valve element against the force of the liquid to open said valve against the force of the liquid until sufficient gas pressure escapes into the working cell to cause the weight of the liquid to again close the valve, thereby producing a repetitive vibration of the valve element and a corresponding repetitive pressure surge within the liquid in the working cell, at least one inclined sieve mounted in the working cell above the valve, means for feeding particulate ore onto the sieve, and means for discharging stratified ore particles.

* * * * *